United States Patent [19]

Williams

[11] Patent Number: 4,714,174

[45] Date of Patent: Dec. 22, 1987

[54] SPILL PROOF CONTAINER

[76] Inventor: James A. Williams, No. 9 Terraza Del Oeste, Harvey, La. 70058

[21] Appl. No.: 910,504

[22] Filed: Sep. 23, 1986

[51] Int. Cl.[4] ..... B65D 51/18; A47G 19/32; A47G 23/06

[52] U.S. Cl. ..... 220/90.4; 220/254

[58] Field of Search ..... 220/90.2, 90.4, 90.6, 220/1 H, 254

[56] References Cited

U.S. PATENT DOCUMENTS

| | | | |
|---|---|---|---|
| 898,894 | 10/1907 | Stephenson | 220/254 |
| 1,509,734 | 9/1924 | Langley | 220/90.4 |
| 1,756,760 | 4/1930 | Reich | 220/1 H |
| 2,152,285 | 3/1939 | Schirmer | 220/1 H |
| 2,278,586 | 4/1942 | Potter . | |
| 2,414,697 | 1/1947 | Pettersson . | |
| 3,116,927 | 1/1964 | Kuhlman . | |
| 3,307,602 | 3/1967 | Boster | 220/254 |
| 4,328,904 | 5/1982 | Iverson . | |

FOREIGN PATENT DOCUMENTS

| | | | |
|---|---|---|---|
| 2454222 | 5/1976 | Fed. Rep. of Germany | 220/90.4 |
| 1428356 | 3/1976 | United Kingdom . | |

OTHER PUBLICATIONS

Tumblers and Accessories by Tupperware (c11) 1977, Tupperware Brochure

*Primary Examiner*—George E. Lowrance

*Attorney, Agent, or Firm*—C. Emmett Pugh

[57] ABSTRACT

A "spill-proof" bowl, particularly suitable for a child, for a dry, granular foodstuff to be eaten by hand, comprising a bowl having a hollow interior therein substantially covered over by a cover located on an open end of the bowl for substantially closing off the hollow interior. A tubular portion centrally located in the cover terminates with an inwardly curved edge at its lower extremity in a relatively small, open end for forming an open closure spaced in the hollow interior below the midpoint between the cover and the base to provide visual and selective access to the dry, granular foodstuff located in the hollow interior of the bowl when open. A portion of the tubular portion extends upwardly and terminates in an open, upper end spaced above the cover. A tubular passage depends downwardly through the tubular portion and communicates with the hollow interior of the bowl by means of the open closure means. A cap spaced above the bowl cover is removably located on the open, upper end, completely closing off the open closure and egress and access to the dry, granular foodstuff. The bowl, when suitably sized, can also be used by adults as a "spill-proof" bowl for foodstuff, and, in either event, the diameter of the tubular passage is just a little bit greater than the lateral dimension of the human hand for whom it was designed, the total opening to the hollow interior being otherwise no more than that necessary for hand access.

12 Claims, 3 Drawing Figures

SPILL PROOF CONTAINER

BACKGROUND OF THE INVENTION

1. Field of the Invention

The present invention relates generally to a "spill-proof" container, and more particularly to a dry foodstuff container. Even more particularly the present invention relates to a "spill-proof" bowl for hand-eating by a person, particularly but not exclusively a small child, having a relatively small, centrally located, relatively small, open top area with the opening leading into a centrally located, vertically disposed tube leading down into the hollow interior of the much larger diameter bowl containing the foodstuff. A cap may be included for closing off the central opening when desired. The central tube prevents to a substantial degree the spillage of the foodstuff, when the bow is dropped or turned over.

2. Prior Art & General Background

Many types of containers and closures are well known in the prior art. For example, a cylindrical container with a screw on or snap on lid has been used to store a variety of items, a number of which have been manufactured by the "Tupperware" Company. However, these screw on and snap on container closures exhibit a significant disadvantage. When the container is opened to gain access to the contents thereof, there is an exposure of the contents to spillage through the open aperture created by removal of the closure. While this problem may be considered only an inconvenience by adults, the problem is a significant one when the container is primarily intended for use by small children.

U.S. Pat. No. 4,328,904 to Iverson (issued May 11, 1982) discloses a "spill-proof" container and a closure for use therewith by small children, which incorporates a plurality of overlapping arcuate flaps of a resilient and flexible nature for providing a closure to the container, wherein the container may be tightly sealed to prevent spillage, but may also be directly accessed by the user by the penetration of the user's hand through the approximate center of the closure. However, the overlapping arcuate flaps providing the closure are not easily cleaned when the container is used with open foodstuffs, which may tend to collect particles of foodstuff between the overlap of the flaps. Additionally, when the flaps and the container are opaque, it is not easy for a child to see the contents and selectively remove a selected portion of its contents. Also, the flaps themselves, although moveable, still represent a physical barrier to a child.

For another example of a "spill-proof" container, although not particularly adapted for use with small children; see, for example, U.S. Pat. No. 3,116,927 to Kuhlman, which uses a slit, resilient diaphragm to access its interior.

For an example of a drinking cup for an infant, see U.S. Pat. No. 2,278,586 to Potter (issued Apr. 7, 1942), which discloses a measuring shell located in an outer cup container, which is provided with a port at its bottom that communicates with a liquid in a void between the shell and the container and controls the rate by which the shell fills, allowing the infant to obtain only a measured quantity of liquid at one time. For a further example of a drinking cup for an infant, see for example, U.S. Pat. No. 2,414,697 to Pettersson (issued Jan. 21, 1947), which provides a drinking cup having a removable cover, which includes an indented cup-shaped recess with an opening in its lower surface positioned at one side of the cover, and a depending centrally positioned tubular element with a relatively small opening in its lower end thereof extending from the lower surface of the cover into the cup. The cup provides a drinking cup especially adapted to eliminate the spilling of milk or other fluids by children when learning to drink from a cup.

For an example of a non-spill, open-top container for paint or granual materials, for example assembly line parts, considered to be a non-analogous art, see British Patent Specification No. 1,428,356 to Hunter (published Mar. 17, 1976). The container includes a tapered collar extending from the cover of the container to terminate above its base. The geometry of the container is such that, for a volume of water or other fluent material less than or equal to the volume of an inverted trough defined by the collar, cover and sidewall of the container, the fluent material is contained within and will not spill out, if the container is tilted or inverted. In contrast to the relatively small dimensions and higher aspect of the preferred embodiment of the invention, the Hunter paint container is somewhat squat, awkward and not practical to be used for example as a bowl for dry cereal or the like for a small child, as is the present invention.

Applicant knows of no art suitable for use by small children which prevents a dry, granular foodstuff when placed in a container such as a bowl from being spilled out if the container is tilted or inverted and which may be easily cleaned. Further, applicant knows of no art suitable for use by small children which when opaque allows visual access to the contents of the container for removal of selective portions of the contents while preventing a dry, granular foodstuff when placed in a container such as a bowl from being spilled out if the container is tilted or inverted.

Accordingly, it is an object of the present invention to provide a suitable method and apparatus for use by small children which prevents a dry, granular foodstuff, such as for example cereal, from being spilled when tilted or inverted.

Accordingly, it is also an object of the present invention to provide a suitable method and apparatus for use by small children prevents a dry, granular foodstuff from being spilled when tilted or inverted and which may be easily cleaned and is easy for a child to use.

Accordingly, it is a further object of the present invention to provide a suitable method and apparatus for use by small children which prevents a dry, granular foodstuff from being spilled when tilted or inverted, which may be easily cleaned and which when opaque allows visual access to the tents o the container for the easy removal of selective portions of the contents.

GENERAL DISCUSSION OF THE INVENTION

In accordance with the above objects, the method and apparatus according to the present invention features a child's "spill-proof" bowl for a dry, granular foodstuff, such as for example, cereal, comprising a container having a hollow interior therein between its interior surfaces. A vertically disposed, centrally located, tubular portion is located in an opening in a cover for closing off the hollow interior and includes a lower portion which extends downwardly into the hollow interior and terminates in a relatively small, open end. The large open end is separated from the base for forming an open closure means spaced in the hollow interior below the midpoint between the cover and the base and provides visual and physical access into the hollow interior, which, when open, allows the child to have selective access to the contents of the container while preventing substantial spillage when the bowl is accidentally upset or tilted.

Included with the tubular portion is an upper portion attached to the lower portion which extends upwardly from the opening and terminates in an open, upper end spaced above the cover having a large diameter at least equal to the diameter of the large open end. A tubular passage having a diameter at least equal to the diameter of the large, open end depends downwardly through the tubular portion from its open upper end and communicates with the hollow interior of the container by means of the open closure or tubular means. A cap or closing means is spaced above the large open end and removably located on the open, upper end for closing off the open closure means and egress and access to the dry, granular foodstuff located in the hollow interior of the container to prevent contamination of the foodstuff and to additionally prevent any spillage of the foodstuff.

The above and other features of the present invention will become apparent from the drawings, the description given herein, and the appended claims.

BRIEF DESCRIPTION OF THE DRAWINGS

The invention may be more fully understood by reference to the following description of the preferred embodiment in conjunction with the drawings, wherein.

DETAILED DESCRIPTION OF THE PREFERRED EMBODIMENT(S)

Figure 3:
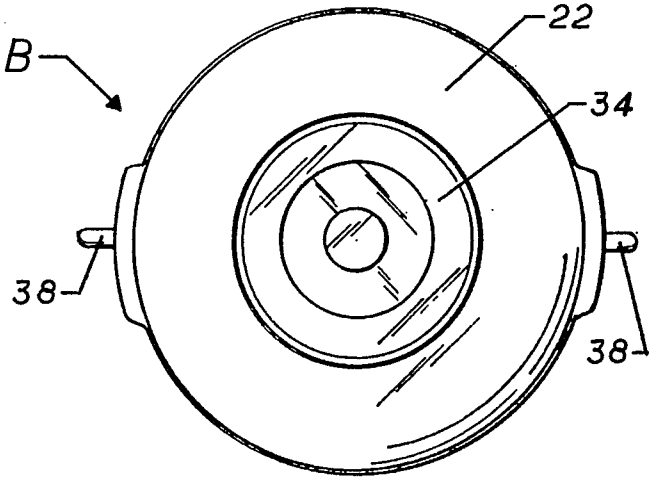
FIG. 3 is a top or plan view of the preferred embodiment of the child's "spill-proof" bowl according to the present invention as shown in FIG. 1.
Figure 2:
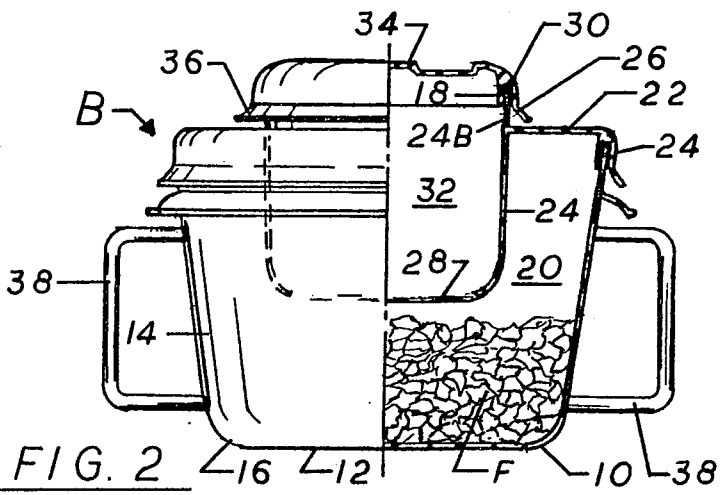
FIG. 2 is a side, partly sectional view of the preferred embodiment of the child's "spill-proof" bowl according to the present invention as shown in FIG. 1, showing foodstuff, such as for example dry cereal, in the bowl.
Figure 1:
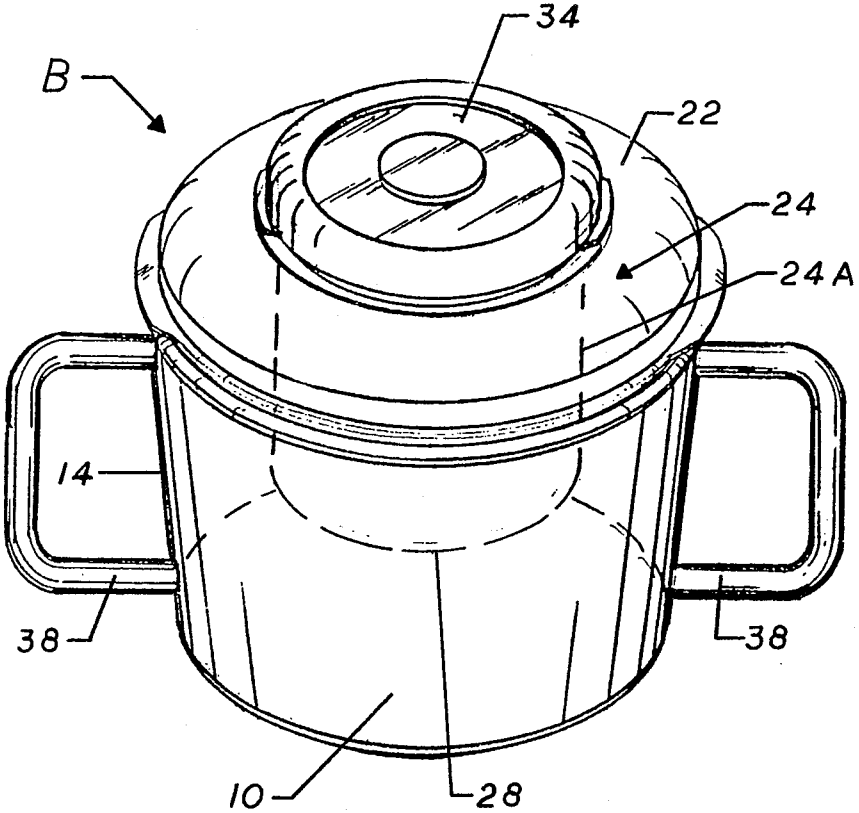
FIG. 1 is an elevational view of the exemplary, preferred embodiment of a child's "spill-proof" bowl according to the present invention.

Referring to FIGS. 1, 2 and 3, a preferred embodiment of a child's "spill-proof" bowl B according to the present invention for hand feeding and eating a dry, granular foodstuff F is seen. The bowl B includes a container 10 having a circular base 12 and a cylindrical, side wall portion 14, which is attached to the circular periphery 16 of the base 12 and extends upwardly from the base 12 to form the container 10. The container 10 includes a circular open end 18 located at the top of the cylindrical wall portion 14 and a hollow interior 20 therein defined by the inside surfaces of the container 10 between the cylindrical wall portion 14 and the base 12.

As may be appreciated, the base 12 and wall portion 14, as well as the thicknesses of the portions of the embodiment as described in the following, need only be of a sufficient thickness for rigidity and to absorb light blows and falls which would normally be expected with children. Accordingly, the volume of the hollow interior 20 would have substantially the same volume as the volume formed by the exterior surfaces of the container 10.

A cover 22 is located on the open end 18 for closing off the hollow interior 20 of the container 10. As shown in FIG. 2, the cover 22 is removably located on end 18 by any suitable means, such as for example a snap lip 24 or a circular rim extending laterally downward from the cover 22 which threadedly engages the open end or lip portion 18 of the container 10. The cover 22 is easily removable for easy cleaning of the cover 22 and the container 10 and for filling of the container 10 with the desired foodstuff F.

The desired foodstuff F may be any type of dry or semimoist food which a child would desire or need and can eat with its hands. For example, the foodstuff F may be a dry cereal and may contain additional edible items, such as for example slices of apples and oranges, grapes or raisins.

A tubular portion 24, which as shown in the figures as having a cylindrical shape, is centrally located in a similarly shaped opening 26 and may be positioned therein above the base 12 by being formed integrally with the cover 22. Alternatively, there could be provided, for example, a threaded portion on the outside of the tubular portion 24, which would threadedly engage an annular flange surrounding opening 26.

A lower portion 24a of the tubular portion 24 extends downwardly from the opening 26 in the cover 22 a distance below the cover 22 and terminates in a relatively small, open end 28 having a diameter substantially the same as, or a little bit larger than, the lateral dimension of a child's small hand. The relatively small, open end 28, as shown in FIG. 2, is separated from the base 12 and allows the child to insert his or her hand through the open end 28 to remove a portion of the foodstuff F contained in the hollow interior of the container 10.

The relatively small, open end 28 is separated from the base 12 for providing an open closure means spaced in the hollow interior 20 of the container 10 below the vertical midpoint between the cover 22 and the base 12 of the container 10. As noted, this provides access to the hollow interior 20, and, when open, allows the child to insert his or her hand through the open end 28 to remove a portion of the foodstuff F contained in the hollow interior 20 of the container 10.

Exemplary dimensions for the preferred embodiment for a small child illustrated in the figures are outlined below:

top, outer diameter of bowl B: $5\frac{5}{8}$"
diameter of tubular portion (small child size): $2\frac{3}{4}$"
height of bowl B: 4"
vertical length of tubular portion: 3"
separation distance from bottom of tubular portion to base 12: 2"

An exemplary, lateral diameter for the tubular portion would be about four and a half inches, with the bowl B being proportionally larger than the exemplary child size detailed above.

As exemplary, preferred location for the open closure means would be, with a distance of three and three-quarters inches separating the cover 22 from the base 12, two and five-eighths inches below the cover or a substantial three-quarters of an inch below the midpoint of one and seven-eighths inches, with the ratio of the spacing of the open closure means below the cover 22 to the midpoint between the cover 22 and the base 12 being on the order of one and two-fifths to one or greater.

The relatively small, open end 28 provides the open closure means when end 28 is spaced below the midpoint between the cover 22 and the base 12, and the open closure means has a diameter substantially less than the diameter of the container 10, with the ratios of their diameters being on the order of or greater than one to one and four fifths, for example three and one-eighths or, as noted above, two and three-quarters of an inch for the diameter of the open closure means and five and a five-eighths of an inch for the diameter of the container 10. This causes the bowl B, when accidentally upset or tipped, to restrain the spillage of foodstuff F contained in the hollow interior 20 of the container 10.

The tubular portion 24 includes an upper portion **24*b* attached centrally to the lower portion 24*a*, the two forming a continuous, cylindrical structure; note FIGS. 1 and 2. The upper portion 24*b* extends upwardly from opening 26 and terminates in an open upper end 30 spaced above the cover 22**.

The open, upper end 30 is spaced vertically above the relatively small, open end 28 and has a diameter at least equal to the diameter of the relatively small, open end 28. The open, upper end 30 communicates with a tubular passage 32, which depends downwardly through the tubular portion 24 to communicate with the hollow interior of the container by means of the open closure means positioned at the lower extremity of the tubular passage 32, and provides access to the relatively small, open end 28 spaced vertically below. It should be noted that the lower end of the tubular passage 32 terminates in inwardly curved, peripheral lip, which further assists in the isolating action of the tubular means of the foodstuff F when the bowl B is dropped or otherwise tipped over.

The open upper end 30 of the tubular portion 24 and the tubular passage 32 having a diameter substantially equal to the diameter of the relatively small, open end 28 for allowing a child to insert his or her hand through the open end 28 to remove a portion of the foodstuff F contained in the hollow interior 20 of the container 10.

A closing means is spaced above the relatively small, open end 28 and removably located on the open upper end 30 for closing off the open closure means and egress and access to a dry, granular foodstuff F located in the hollow interior 20 of the container 10 by means of the tubular passage 32 and the open closure means. As shown in the figures, the closing means includes a lid 34 which may be removably located on the open upper end 30. The cap or lid 34 may be removably located on upper end 30 by means of an annular snap lip 36 or by any other suitable means, such as a circular rim extending laterally downwardly from the lid 34, which threadedly engages the open upper end or lip portion 30 of the container 10. The cap 34 is thus removable for easy cleaning of the lid 34 and the container 10, including the tubular portion 24, and, when removed, may also be used to fill the container 10 by means of the tubular passage 32 communicating with the open closure means positioned at the lower extremity of the tubular passage 32.

As may be appreciated, the closing means when positioned on the open upper end 30 to close off the open closure means, provides a means for preventing contamination of the foodstuff F contained in the container 10 from dust particles in the air as well as various types of insects and pests, as well as affording an additional means for preventing spilage of the foodstuff F.

In use, the cover 22 is removed from end 18 of the container 10, and the hollow interior 20 of the container 10 is filled to a suitable depth with the desired foodstuff F, and the cover 22 is replaced on the open end 18 of the container 10 for substantial closing the hollow interior 20 of the container 10 and the contents therein. As an alternate, the lid 34 may be removed from end 30 of the tubular portion, allowing the hollow interior 20 to be filled to a suitable depth with the desired foodstuff F by means of the open end 30 and the tubular portion 24, which communicates with the hollow interior 20 by means of the open closure means positioned at the lower extremity of the tubular passage 32. The lid 34 may be replaced on the open end 30 of the tubular portion 24, whenever desired, to prevent contamination of the foodstuffs F within the container 10.

The child may then, by removing the lid 34 when replaced on the open end 30 of the tubular portion 24, have access to the open closure means and the foodstuff contents within the hollow interior of the container 10 by inserting his hand down through the open, upper end 30 of the tubular portion 24, the tubular passage 32 and the open closure means at the lower extremity of the tubular passage 32 to remove by hand a selected portion of the foodstuff F within the container 10. As may be appreciated, the relatively small, open end 28, the tubular passage 32 and the open upper end 30 of the tubular portion 24 allow the child to have visual access to the contents and allows the child to have selective access to the foodstuff within, by for example tilting the container and by slight shaking movements selectively remove particular edible item(s) as desired.

The child when finished accessing the foodstuff F may replace the lid 34 on the open upper end 30 of the tubular portion 24, then completely closing off the open closure means below the prevent contamination of the foodstuff F within the container 10 and to provide an additional means for preventing spillage of the foodstuff F.

Accordingly, the "spill-proof" bowl B will prevent any substantially spillage of the foodstuff F when accidentally dropped, upset or tilted or otherwist tipped over, and, with the lid 34 replaced on the open upper end 30 of the tubular portion 24, any spillage as well as contamination of the foodstuff F is absolutely prevented.

As may be appreciated, the "spill-proof" bowl B may be provided with a handle or a pair of handles 50, as illustrated, attached to the cylindrical wall portion 14 to provide a means to easily manipulate and carry the bowl B without accidentally dropping the bowl B.

Although having particularly efficacious application to use by a child, the present invention can be applied to a bowl for use by all ages, including adults, by appropriately sizing the opening to allow the adult size hand to enter. The bowl could then be very effectively used, for example, for snacks at parties or other gatherings, or in vehicles, etc., where there is a reasonable likelihood of it being knocked or otherwise tipped over.

It is finally noted that, although the bowl of the invention has been highly effective in preventing spills, it is not claimed that, when the top is off, there is absolutely no spillage of the foodstuff possible. However, in the context that it prevents most, if not all, of the contents from being spilled out when knocked over or dropped, the bowl is "spill-proof."

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. A "spill-proof" bowl for eating at least somewhat dry, granular foodstuff by hand, comprising:

a container base having a peripheral wall attached around its periphery and extending upwardly from said base for forming a container having a hollow interior therein between the interior surfaces of said wall and said base, said container including a relatively large, open end opposite its base for access to said hollow interior;

a cover located on the relatively large, open end of said container for substantially closing off said hollow interior; and a tubular portion located in a relatively small opening in said cover and positioned above said base, said relatively small opening having a lateral dimension substantially equal to the lateral dimension of the human hand of the size for which it was designed, said tubular portion including a lower portion extending downwardly from said relatively small opening a distance below said cover and having a relatively small, lower, open end at its lower end separated up from said base for forming an open closure means spaced in said hollow interior below the midpoint between said cover and said base for providing visual and selective access to said hollow interior when open, and an upper portion attached to said lower portion and extending upwardly from said relatively small, open end of said lower portion to terminate in an open, upper end extended and spaced above said cover and said container base having a diameter at least equal to the diameter of said relatively small, open end for access to a tubular passage having a diameter at least equal to the diameter of said relatively small, open end depending downwardly through said tubular portion to communicate with said hollow interior of said container by means of said open closure means; said tubular portion isolating a foodstuff contained between the interior surfaces of said wall and the exterior of said tubular portion away from said relatively small opening when the bowl is tipped over but allowing free access to the foodstuff in the hollow interior by the user's hand without any otherwise un-necessary open area into said interior, "spill proofing" the bowl, said lower end further having an annular portion surrounding the periphery of said relatively small, open end which curves radially inward to form an inwardly directed lip for further ioslating the foodstuff contained in said hollow interior from entering said relatively small, open end when the "spill-proof" bowl is tipped over, said annular portion having an opening suitable for access to the foodstuff by the human hand and providing an inwardly directed lip which radially widens outward to the diameter of said tubular passage for restraining entry into the tubular passage when the "spill-proof" bowl is tipped over; and closing means spaced above said upper, open end and removably located on said open, upper end for closing off said open closure means and egress and access to the dry, granular foodstuff located in said hollow interior of said container by means of said tubular passage and said open closure means.

2. The "spill-proof" bowl of claim 1, wherein said upper, open end of said container has a diameter substantially the same as the diameter of said lower, open end forming a cylindrical tube.

3. The "spill-proof" bowl of claim 2, wherein said relatively small, open end has a diameter substantially equal to the lateral dimension of a child's hand.

4. The "spill-proof" bowl of claim 3, wherein said relatively small, open end had a diameter of less than about two and a quarter inches.

5. The "spill-proof" bowl of claim 1, wherein said closing means, when located on said open upper end to close off said open closure means, provides a means for preventing contamination of the foodstuff contained in said container.

6. The "spill-proof" bowl of claim 5, wherein said closing means provides an additional means for preventing spillage of the foodstuff.

7. The "spill-proof" bowl of claim 1, wherein said container is round and said tubular portion is cylindrical and centrally located along the vertical, central axis of the container's round shape.

8. The "spill-proof" bowl of claim 1, wherein said lip is curved inwardly forming a curved lip about the periphery of said tubular portion.

9. The "spill-proof" bowl of claim 1, wherein at least one handle is provided on the side, exterior wall of said container, assisting in the hand manipulation of the bowl when in use by the eater.

10. The "spill-proof" bowl of claim 9 wherein a pair of handles are provided on opposite sides of said container.

11. A method of "spill-proofing" a dry foodstuff contained in a bowl, while also allowing it to be freely eaten by hand by a child or the like, comprising the steps of:

(a) providing a "spill-proof" container including a bowl having a substantial part of its top closed but with a relatively small, open, lower end, having a lateral dimension essentially equal to the lateral dimension of a human hand, positioned in the hollow interior of the bowl below the vertical midpoint of the bowl to prevent substantial spillage of the dry, granular foodstuff contained in the hollow interior of the bowl when the "spill-proof" bowl is tipped over;

(b) providing access to the relatively small, open end by means of a tubular portion having a lateral dimension essentially equal to the lateral dimension of the human hand which includes a lower portion that extends from the exterior of the bowl downwardly and terminates past the midpoint of the bowl in the relatively small, open end;

(c) providing an upper portion of the tubular portion which extends from the exterior of the bowl above the top of said bowl with an open upper end having a diameter at least as large as the diameter of the relatively small, open end and closing means spaced above said upper, open end and removably located on said open, upper end for closing off said open closure means and egress and access to the dry, granular foodstuff located in said hollow interior of said container by means of said tubular passage and said open closure means.

(d) providing a tubular path which depends downwardly from the open upper end and extends through the tubular portion to communicate with the hollow interior of the bowl by means of the relatively small, open end to allow open access to the interior by the human hand;

(e) allowing the user to visually select a portion of the dry foodstuff contained in the hollow interior by a visual path through the tubular path and the relatively small, open end to the hollow interior of the bowl and the foodstuff contained therein;

(f) freely allowing the human hand through the open upper end of the tubular portion down through the tubular path and through the relatively small, open end when said closing means is off to selectively remove a portion of the foodstuff contained in the hollow interior of the bowl but substantially preventing any spilling of the foodstuff from the bowl, should the bowl be tipped over, by said tubular means isolating the foodstuff to move to the interior of the bowl between its sidewalls and the exterior of the said tubular means;

(g) providing an annular portion surrounding the periphery of the relatively small, open end which is directed radially inwardly from the lower end of the tubular portion to form an inwardly directed lip for further isolating the foodstuff contained in said hollow interior from entering said open end; and (h) further restraining the foodstuff from entering the tubular portion by having the inwardly directed lip radially widen outward to the diameter of the tubular passage for providing the relatively small open end with an opening suitable for access to the foodstuff by the human hand, while having the inwardly directed lip which radially widens restrain entry into the tubular passage when the "spill-proof" bowl is tipped over.

12. The method of claim 11, wherein there is included the additional step of:

covering the relatively small, open end in the hollow interior of the bowl with a removable cover spaced above the relatively small, open end and removably located on the open, upper end of the tubular portion to prevent contamination of the foodstuff.

* * * * *